US008240355B2

(12) United States Patent
Bullied et al.

(10) Patent No.: US 8,240,355 B2
(45) Date of Patent: Aug. 14, 2012

(54) FORMING A CAST COMPONENT WITH AGITATION

(75) Inventors: Steven J. Bullied, Pomfret Center, CT (US); John Joseph Marcin, Marlborough, CT (US); John F. Blondin, South Windsor, CT (US); Mark F. Bartholomew, Enfield, CT (US)

(73) Assignee: United Technologies Corporation, Hartford, CT (US)

( * ) Notice: Subject to any disclaimer, the term of this patent is extended or adjusted under 35 U.S.C. 154(b) by 148 days.

(21) Appl. No.: 12/696,304

(22) Filed: Jan. 29, 2010

(65) Prior Publication Data

US 2011/0186258 A1 Aug. 4, 2011

(51) Int. Cl.
*B22C 9/04* (2006.01)
*B22D 27/08* (2006.01)

(52) U.S. Cl. ..... 164/35; 164/71.1; 164/114; 164/516

(58) Field of Classification Search ..... 164/35, 164/516–519, 71.1, 114, 115
See application file for complete search history.

(56) References Cited

U.S. PATENT DOCUMENTS

| | | | | |
|---|---|---|---|---|
| 2,848,775 | A | 8/1958 | Ettenreich | |
| 3,981,344 | A | 9/1976 | Hayes et al. | |
| 4,078,951 | A | 3/1978 | Denzine et al. | |
| 4,462,454 | A * | 7/1984 | Hellawell | 164/133 |
| 4,568,398 | A | 2/1986 | Wood et al. | |
| 5,291,654 | A | 3/1994 | Judd et al. | |
| 5,931,214 | A * | 8/1999 | Spicer et al. | 164/258 |
| 6,932,145 | B2 * | 8/2005 | Frasier et al. | 164/122.2 |
| 6,986,381 | B2 | 1/2006 | Ray et al. | |
| 7,201,212 | B2 | 4/2007 | Bullied et al. | |
| 7,306,026 | B2 | 12/2007 | Memmen | |
| 2003/0121636 | A1 * | 7/2003 | Gegel et al. | 164/35 |
| 2008/0169078 | A1 | 7/2008 | Ienaga et al. | |

FOREIGN PATENT DOCUMENTS

| | | |
|---|---|---|
| GB | 1515933 | 6/1978 |

* cited by examiner

*Primary Examiner* — Kuang Lin
(74) *Attorney, Agent, or Firm* — Carlson, Gaskey & Olds

(57) ABSTRACT

A method of forming a cast component includes at least partially surrounding an investment mold in a heat-insulating packing material, feeding a molten alloy into the investment mold to provide a filled investment mold, and agitating the filled investment mold while solidifying the molten alloy.

20 Claims, 1 Drawing Sheet

FORMING A CAST COMPONENT WITH AGITATION

BACKGROUND

This disclosure relates to casting metal alloy materials to achieve a more uniform microstructure.

Investment casting is known and used for fabricating near net shape components of relatively complex geometries from high temperature alloys. Typically, the process includes forming a wax pattern of the component and coating the wax pattern with a ceramic slurry. The slurry is fired to form a refractory shell investment mold and the wax is removed from the interior to form a molding cavity within the shell. A molten alloy is then poured into the cavity to form the component.

SUMMARY

An example method of forming a cast component includes surrounding at least a portion of an investment mold with a heat-insulating material, feeding a molten alloy into the investment mold that is packed in the heat-insulating packing material to provide a filled investment mold, and agitating the filled investment mold while solidifying the molten alloy.

In another aspect, an example method of forming a cast component includes feeding a molten alloy into an investment mold that is surrounded by a heat-insulating packing material to provide a filled investment mold, and agitating the filled investment mold by solidifying the molten alloy.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
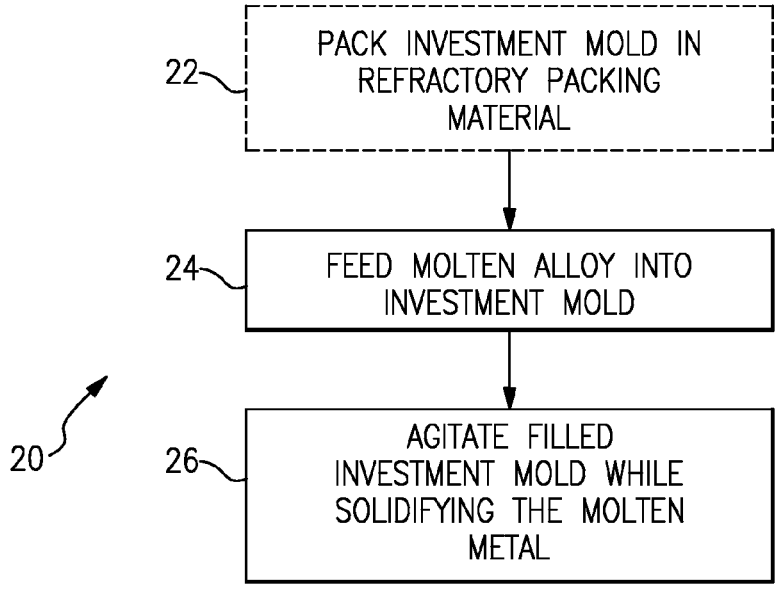
FIG. 1 illustrates example methods of forming a cast component.

FIG. 1 illustrates an example method of forming a cast component, such as a turbine blade or other type of component. Cast structures or components may have a distinct alloy microstructure with regard to grain size and grain size distribution that depends on the rate of heat removal during casting and solidification. The grain structure controls the properties and behavior of the component during service. One premise of this disclosure is that different cooling rates in different locations of a component during solidification result in different microstructures at those locations that cause a variance in the properties of the component from location to location. The method 20 may be employed, as will be described below, to facilitate mitigating such differences in microstructure and thereby provide a smaller and more uniform grain size throughout a component.

In the illustrated example, the method 20 may include a packing step 22, a feeding step 24, and an agitating step 26. As represented by the dashed line outlining the packing step 22, this step may be conducted separately in time or space from the feeding step 24 and the agitating step 26. Thus, in some examples, the packing step 22 may not be considered to be part of the method 20.

The packing step 22 may include packing an investment mold in a heat-insulating packing material. As an example, the investment mold may be formed in a known manner by casting a ceramic slurry around a wax core to form a refractory shell that serves as the investment mold. It is to be understood that the investment mold is not limited to any particular type and the method 20 disclosed herein may be adapted for use with many different types of investment molds.

Figure 2:
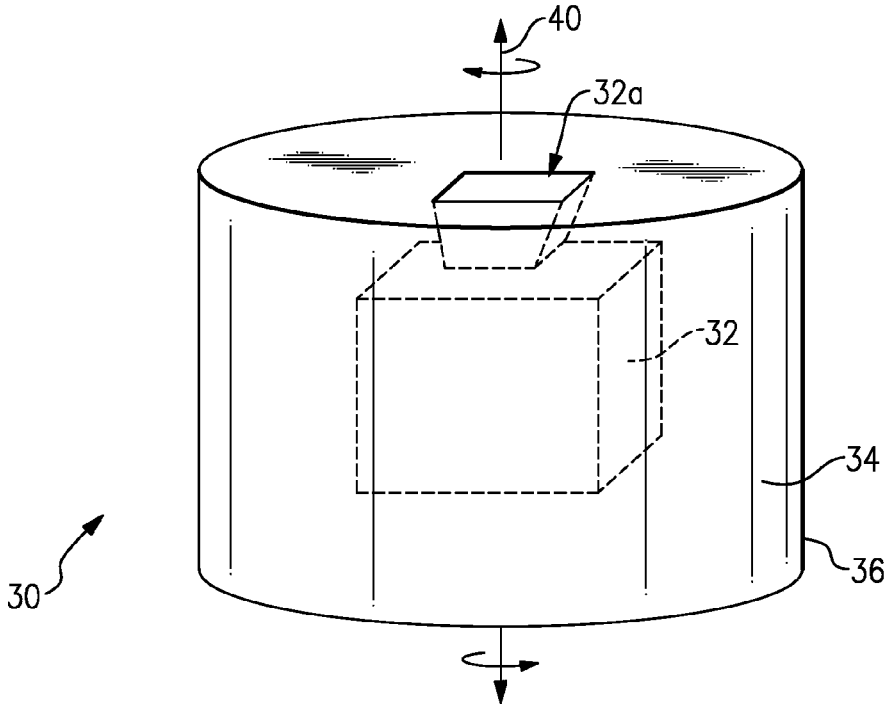
FIG. 2 illustrates an example packing that includes an investment mold packed within a heat-insulating packing material.

FIG. 2 illustrates an example of a packing 30 that is packed according to the packing step 22. In this case, an investment mold 32 is packed in a heat-insulating packing material 34 within a vessel 36. The illustrated vessel 36 is a cylindrical container but in other examples may have another shape that suitable for the particular process. In this case, the cylindrical shape of the vessel 36 facilitates handling the packing 30 between the feeding step 24 and the agitating step 26, such as with an automated machine (e.g., a robot).

The heat-insulating packing material 34 may be a granular ceramic material that is loaded into the vessel 36 along with the investment mold 32. For instance, a base layer of the granular ceramic material may be deposited on the bottom of the vessel 36 and the investment mold 32 may be placed on the base layer. Additional granular ceramic material may be provided around the investment mold 32 such that there is a relatively uniform amount of the granular ceramic material between the walls of the investment mold 32 and the walls of the vessel 36. In this case, a top portion 32*a* of the investment mold 32 may remain exposed relative to the heat-insulating packing material 34 to allow feeding the molten alloy into the investment mold 32.

The granular ceramic material may be an oxide, a carbide, a nitride, or combinations thereof. In one example, the granular ceramic may be alumina. In any case, the granular ceramic material thermally insulates the investment mold 32 such that the molten metal, once poured into the investment mold 32, remains molten while the packing 30 is handled, as will be described below.

After packing the investment mold 32 in the heat-insulating packing material 34, the packing 30 may be moved into a casting furnace to conduct the feeding step 24. As an example, the casting furnace may be a standard type of casting furnace and need not necessarily be specially designed with regard to the agitating step 26. That is, the agitating step 26 may be conducted in a second, separate and distinct machine (e.g., an agitator). The molten alloy is fed into the investment mold 32 that is packed in the heat-insulating packing material 34 to provide a filled investment mold. For instance, the molten metal may be poured from a refractory ladle or the like, as is generally known.

The packing 30 may then be removed from the casting furnace into an agitator that is separate from the casting furnace to conduct the agitating step 26. The packing 30 provides the benefit of insulating the investment mold 32 during movement of the packing 30 between the feeding step 24 and the agitating step 26 to limit or prevent solidification of the molten alloy. Thus, a standard type of casting furnace may be used and there is no need to specially adapt this machine for agitation or vibration. The separate agitator can be a very simple type of machine and the method 20 therefore provides an economical solution to casting components with agitation.

The agitator agitates the filled investment mold while the molten alloy solidifies. As an example, the agitator may rotationally agitate the packing 30 about an axis 40. The axis 40 may be a central axis of the investment mold 32 or component within the investment mold 32, or other desired axis, such as a vertical axis. In this case, the agitator may rotate the packing 30 back and forth about the axis 40. As an example, the agitator may change between rotation directions (i.e., clockwise and counterclockwise) after predetermined periods of rotation and rotate the packing 30 at an angular velocity of 10-500 revolutions per minute in the given direction. In some examples for casting a turbine blade, the angular velocity may be 30-80 revolutions per minute. In a further turbine blade example, the angular velocity is approximately 50 revolutions per minute. The periods of rotation may be approximately 1-10 seconds. For instance, the agitator may cyclically rotate the packing 30 clockwise for about three seconds and then counterclockwise for about one second. Each cycle includes one rotation clockwise and one rotation counterclockwise. The frequency may refer to the angular velocity or number oscillations per unit time, and the amplitude may refer to the angular travel about the axis 40. The frequency and amplitude may be predetermined depending upon the particular design of the component.

During agitation, the movement of the packing 30 serves to break up the solids that begin to form during the cooling of the molten alloy. Thus, the agitation refines the grain structure by fragmenting the solids that form initially from the liquidus state of the molten alloy and thereby provides a smaller and more uniform microstructure throughout the component. Thus, the heat-insulating packing material 34 in combination with the agitation facilitates reducing the difference in microstructure from location to location that might normally occur from different cooling rates at the different locations. After solidification, the investment mold 32 may be removed from the heat-insulating packing material 34, and the investment mold 32 subsequently removed from the molded component in a known manner. The heat-insulating packing mater 34 may then be reused with another investment mold 32 for subsequent molding cycles.

In some examples, the feeding step 24 may be conducted under a first pressure atmosphere (e.g., less than ambient pressure) and the agitating step 26 may be conducted at a higher, second pressure atmosphere. In cases where reaction of the molten alloy with the surrounding atmosphere is a concern, a protective gas may be flowed over the exposed top portion 32*a* of the investment mold 32 to blanket the molten alloy from reacting with the surrounding atmosphere. As an example, a protective gas such as argon may be used.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method of forming a cast component, comprising:

at least partially surrounding an investment mold in a heat-insulating material;

feeding a molten alloy into the investment mold that is at least partially surrounded in the heat-insulating packing material to provide a filled investment mold; removing the filled investment mold that is at least partially surrounded in the heat-insulating packing material from the casting machine into a separate agitator; and agitating the filled investment mold while solidifying the molten alloy, wherein the feeding of the molten alloy includes feeding in a casting machine and the agitating of the filled investment mold includes agitating in the agitator that is separate and distinct machine from the casting machine.

2. The method as recited in claim 1, wherein the heat-insulating material is a granular ceramic material.

3. The method as recited in claim 2, wherein the granular ceramic material is selected from a group consisting of oxides, carbides, nitrides, and combinations thereof.

4. The method as recited in claim 2, wherein the granular ceramic material is alumina.

5. The method as recited in claim 1, including packing the investment mold and the heat-insulating material in a vessel such that the investment mold is substantially surrounded by the heat-insulating material between walls of the vessel and the investment mold.

6. The method as recited in claim 1, wherein the partially surrounding comprises packing the investment mold in heat insulating material.

7. The method as recited in claim 1, wherein the agitating of the filled investment mold includes rotating the filled investment mold back and forth around an axis of the investment mold.

8. The method as recited in claim 7, including cyclically rotating the filled investment mold back and forth between clockwise and counterclockwise directions at an angular velocity of 10-500 revolutions per minute for periods of rotation of 1- 10 seconds.

9. The method as recited in claim 7, wherein the axis is vertical.

10. The method as recited in claim 1, further comprising reusing the heat-insulating packing material after solidification of the molten metal to pack another investment mold.

11. The method as recited in claim 1, wherein the agitating of the filled investment mold includes rotating the filled investment mold cyclically in a first direction for a first time period and in a second direction for a second, different time period around an axis of the investment mold.

12. The method as recited in claim 5, wherein the packing of the investment mold and the heat-insulating material into the vessel includes depositing a layer of the heat-insulating material onto the bottom of the vessel, placing the investment mold onto the layer and then adding additional heat-insulating material around the investment mold.

13. The method as recited in claim 2, wherein the granular ceramic material is a carbide material.

14. The method as recited in claim 2, wherein the granular ceramic material is a nitride material.

15. A method of forming a cast component, comprising:

feeding a molten alloy into an investment mold that is packed in a heat-insulating packing material to provide a filled investment mold; removing the filled investment mold that is packed in the heat-insulating packing material from a casting machine into a separate agitator that is separate and distinct machine from the casting machine; and agitating the filled investment mold while solidifying the molten alloy, wherein the agitating includes rotating the filled investment mold cyclically in a first direction for a first time period and in a second direction for a second, different time period around an axis of the investment mold.

16. The method as recited in claim 15, including cyclically rotating the filled investment mold at an angular velocity of 10-500 revolutions per minute and wherein the time periods are 1-10 seconds.

17. The method as recited in claim 15, including feeding the molten alloy under an evacuated, first pressure atmosphere in a casting furnace and agitating the filled investment mold under a higher, second pressure atmosphere in an agitator that is separate and distinct from the casting furnace.

18. The method as recited in claim 15, including feeding of the molten alloy in a first machine and then moving the filled investment mold to a second, different machine to conduct the agitation such that the heat-insulating packing material insulates the investment mold so that substantially no solidification occurs during moving of the filled investment mold between the first machine and the second machine.

19. The method as recited in claim 15, further comprising flowing a protective gas over at least an exposed portion of the investment mold during the agitating.

20. The method as recited in claim 15, wherein a ratio the first time period to the second time period is about 3:1.

* * * * *